US007265670B2

(12) United States Patent
Pantus et al.

(10) Patent No.: US 7,265,670 B2
(45) Date of Patent: Sep. 4, 2007

(54) SURVEILLANCE DETECTOR

(75) Inventors: Math Pantus, Brunssum (NL); John Julicher, Sunnyvale, CA (US); Jan Van Woezik, Helenaveen (NL); Maurice Deusings, Bom (NL)

(73) Assignee: General Electric Company, Schenectady, NY (US)

( * ) Notice: Subject to any disclaimer, the term of this patent is extended or adjusted under 35 U.S.C. 154(b) by 299 days.

(21) Appl. No.: 10/490,891

(22) PCT Filed: Sep. 26, 2002

(86) PCT No.: PCT/NL02/00625

§ 371 (c)(1),
(2), (4) Date: Aug. 26, 2004

(87) PCT Pub. No.: WO03/027983

PCT Pub. Date: Apr. 3, 2003

(65) Prior Publication Data

US 2005/0030180 A1 Feb. 10, 2005

(30) Foreign Application Priority Data

Sep. 26, 2001 (NL) ..... 1019039

(51) Int. Cl.
*G08B 13/00* (2006.01)

(52) U.S. Cl. ..... 340/541; 340/552; 340/555; 340/556; 340/561; 340/545.3

(58) Field of Classification Search ..... None
See application file for complete search history.

(56) References Cited

U.S. PATENT DOCUMENTS 4,709,153 A * 11/1987 Schofield ..... 250/353
4,710,629 A * 12/1987 Muller et al. ..... 250/342
5,424,718 A * 6/1995 Muller et al. ..... 340/567
5,489,892 A * 2/1996 Imuro et al. ..... 340/567
5,942,976 A * 8/1999 Wieser et al. ..... 340/565

(Continued)

FOREIGN PATENT DOCUMENTS

EP 0 817 148 1/1998

(Continued)

OTHER PUBLICATIONS

International Search Report for PCT/NL02/00625 dated Dec. 12, 2002.

*Primary Examiner*—Benjamin C. Lee
*Assistant Examiner*—Son Tang
(74) *Attorney, Agent, or Firm*—Eugene Hyun, Esq.; Armstrong Teasdale LLP

(57) ABSTRACT

A surveillance detector comprising a light emitter and a light guide which is optically connected to the light emitter, which light guide includes reflectors mounted therein, a special feature being the fact that the light guide is capable of converting the light from the light emitter at least in part into a light beam to be built up in the space to be kept under surveillance, and in that the light guide is capable of guiding light from the light beam that is reflected by an object in the space to be kept under surveillance to a light receiver of the detector, which is optically coupled to the light guide.

17 Claims, 5 Drawing Sheets

U.S. PATENT DOCUMENTS

| | | | | |
|---|---|---|---|---|
| 6,031,456 | A * | 2/2000 | Hanyuda | 340/555 |
| 6,377,174 | B1 * | 4/2002 | Siegwart et al. | 340/541 |
| 6,469,625 | B1 * | 10/2002 | Tomooka | 340/556 |
| 6,529,129 | B1 * | 3/2003 | Tomooka | 340/556 |

FOREIGN PATENT DOCUMENTS

| | | |
|---|---|---|
| EP | 1 126 430 | 8/2001 |

* cited by examiner

SURVEILLANCE DETECTOR

The invention relates to a surveillance detector comprising a light emitter and a light guide which is optically connected to the light emitter, which light guide includes reflectors mounted therein.

Such a surveillance detector is known from European patent publication No 0 817 148 to the legal predecessor of the present Applicant. The known surveillance detector comprises two light guides disposed along the circumference of a window of the detector, one of which light guides is optically coupled to a light emitter, and the other is being optically coupled to a light receiver. As a result of the specific shape of the light guides, a light beam is built up above the window, the shape of which light beam is such that when an attempt is made to approach the window with an object, the light reflection from said object will result in a change in the light intensity being detected on the side of the light receiver, as a result of which an alarm will be activated. In principle this makes it possible to detect each and every attempt to approach or damage the window or cover it, for example by means of a substance such as a spray.

The object of the invention is to improve the surveillance detector that is known from European patent publication No 0 817 148 in the sense that it will be of simpler design and that it can be used for a wider range of applications.

According to the invention, a surveillance detector of the kind referred to in the introduction is to that end characterized in that the light guide is capable of converting the light from the light emitter at least in part into a light beam to be built up in the space to be kept under surveillance, and in that the light guide is capable of guiding light from the light beam that is reflected by an object in the space to be kept under surveillance to a light receiver of the detector, which is optically coupled to the light guide. In other words, the light guide is optically coupled both to the light emitter and to the light receiver, and consequently it functions as a guide both of emitted light and of received light, depending on the direction in which the light propagates. In addition, the light guide primarily functions to detect attempts at sabotage in the vicinity of the present surveillance detector in the space to be kept under surveillance, i.e. to detect each and every attempt to approach or damage the present surveillance detector or cover it, for example by means of a substance, such as a spray.

It is noted that accordingly the invention primarily relates to the detection by means of the light guide of attempts at sabotage in the vicinity of the present detector in the space to be kept under surveillance, in which the surveillance detector acting as a motion detector ("burglar detector") can function in a manner which is known per se: i.e. as a passive sensor (see U.S. Pat. No. 4,321,594), as an active sensor (see U.S. Pat. No. 4,647,913) or as a combined passive/active sensor (see U.S. Pat. No. 4,195,286).

In one preferred embodiment of a surveillance detector according to the invention, the light beam propagates convergingly from a light guide surface that faces towards the space to be kept under surveillance. In another preferred embodiment, the light beam also propagates divergingly from a distance of 5-100 cm, preferably 20-30 cm, from the light guide surface that faces towards the space to be kept under surveillance. As will be explained in more detail in the description of the Figures, this provides a possibility of timely detection both of approaching "black" objects, i.e. at least substantially light-absorbing objects, and of approaching "white" objects, i.e. at least substantially light-reflecting objects, at a secure distance from the present surveillance detector. Consequently, the detector exhibits homogeneous sensitivity in the sense that "black" and "white" objects are detected within a secure distance margin.

In another preferred embodiment of a surveillance detector according to the invention, the light guide is capable of guiding part of the light from the light emitter to the light receiver before said light exits the detector. In particular, the light guide is capable of guiding 1-50%, preferably 5-30%, of the light from the light emitter to light receiver before said light exits the detector. Preferably, the light from the light emitter that is guided to the light receiver by the light guide before it exits the detector comprises, at least in part, light which is reflected from the light guide surface that faces towards the space to be kept under surveillance. As a result, a lower limit or reference signal is obtained, below or above which the light receiver can activate an alarm. In another preferred variant, the light guide comprises retroflectors for reflecting light which is being scattered back into the light guide to the light receiver, as a result of which the sensitivity of the surveillance detector is enhanced.

In another preferred embodiment of a surveillance detector according to the invention, the light guide guides the light to the light receiver by means of another light guide, which includes reflectors mounted therein. As will be explained in more detail yet in the description of the figures, this provides a possibility of "surveilling" various areas near the present surveillance detector in the space to be kept under surveillance, in particular an area extending from the front side (cover) of the surveillance detector, which is also the window of the surveillance detector. In one preferred variant, said other light guide guides the light to the light receiver via a light-transmitting window of the detector, behind which said light receiver is disposed.

In another preferred embodiment of a surveillance detector according to the invention, the window comprises an outwardly extending projection. The projection is preferably located near the optical axis of the light receiver so as to effect an efficient interception of light rays from the other light guide and subsequently direct said light rays at the window so as to increase the percentage of the light that is received by the light receiver. In this way, the sensitivity of the present surveillance detector is enhanced.

In another preferred embodiment of a surveillance detector according to the invention, said other light guide tapers off into a pointed shape, adjoining surfaces of which form internal reflection surfaces which are inclined at a certain angle so as to cause the light to exit along a desired path.

In another preferred embodiment of a surveillance detector according to the invention, the surveillance detector comprises alarm means for generating an alarm in the case that the light received by the light receiver corresponds to a signal value which is higher than a maximum level or lower than a minimum level.

In another preferred embodiment of a surveillance detector according to the invention, the surveillance detector comprises a passive sensor for detecting an object entering the space to be kept under surveillance. Said passive sensor is in particular a passive infrared sensor.

In another preferred embodiment of a surveillance detector according to the invention, the surveillance detector comprises an active sensor for detecting an object entering the space to be kept under surveillance, in which said active sensor comprises a wave signal source and a wave signal detector coupled thereto. Said wave signal source and said wave signal detector preferably operate on the basis of ultrasonic waves or microwaves, with acoustic and electromagnetic coupling, respectively.

The invention will be explained in more detail hereinafter with reference to figures illustrated in a drawing, in which.

Figure 1:
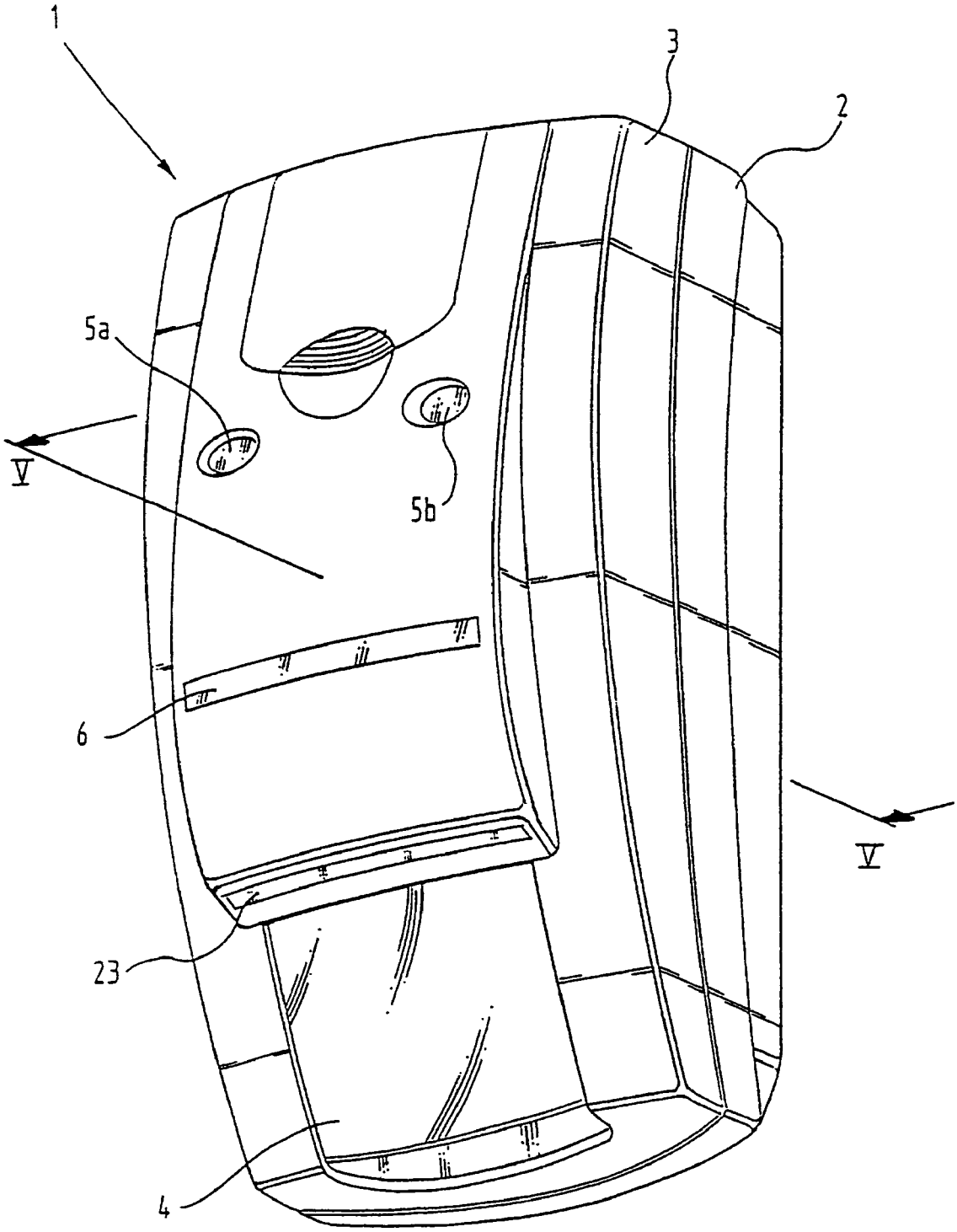
FIG. 1 is a schematic, perspective view of a surveillance detector according to the invention.
Figure 5:
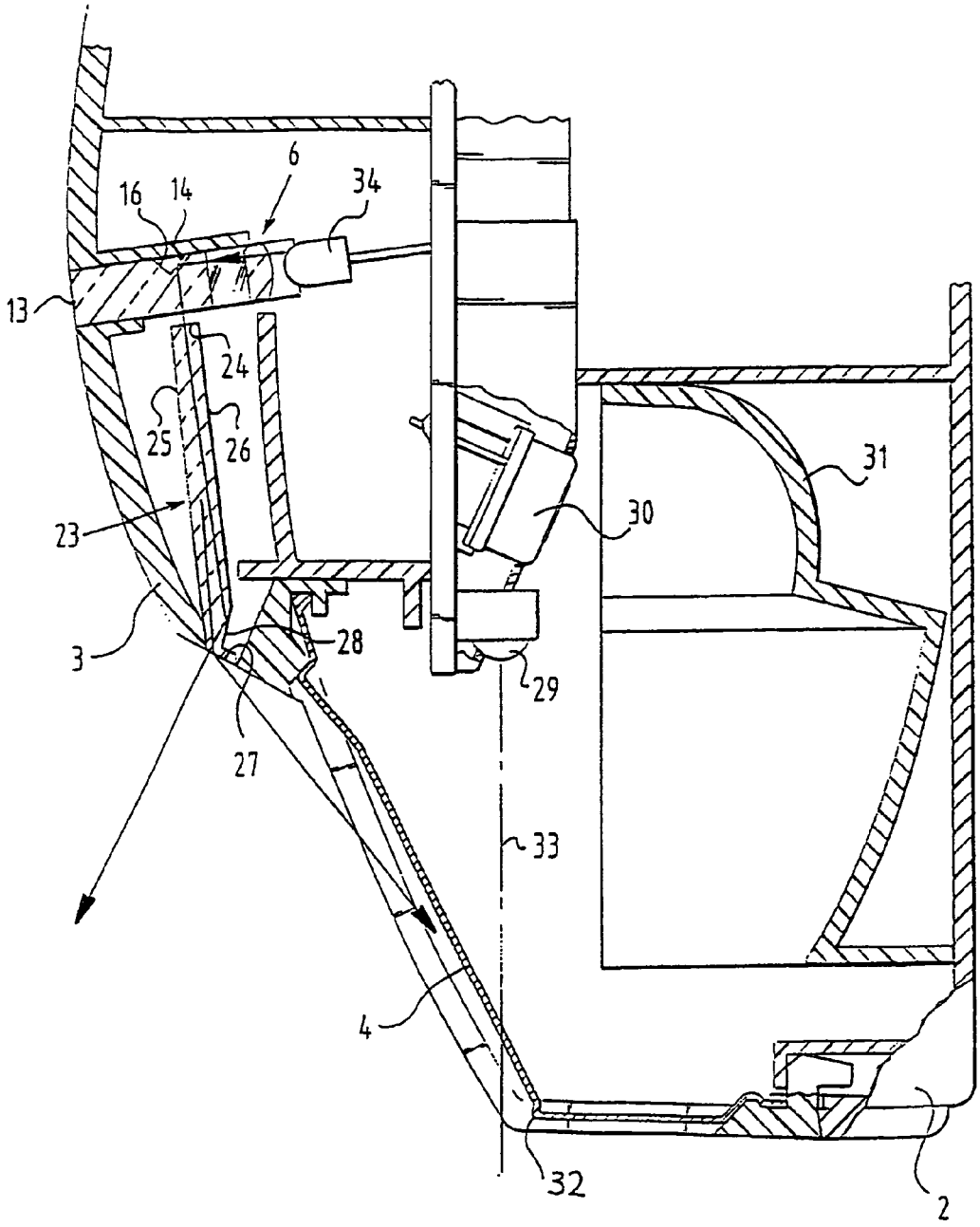
Figure 6:
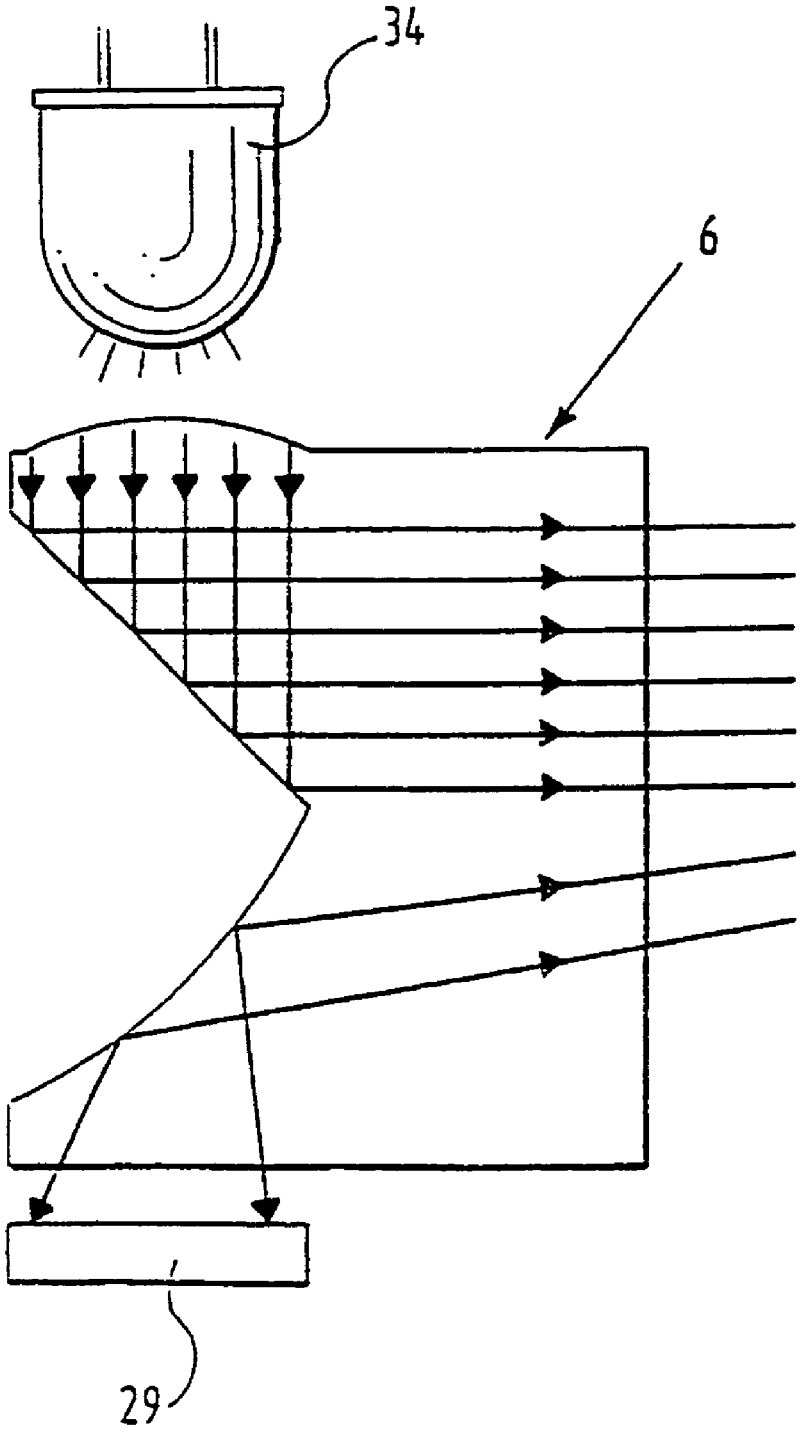

FIG. 5 schematically shows the way in which the first and second light guides and the other components of the surveillance detector of FIG. 1 are optically coupled; and FIG. 6 is a schematic view of the principle of operation of the first light guide.

In FIG. 1 there is shown a perspective front view of a passive infrared surveillance detector according to the invention which is disposed in a space to be kept under surveillance, which detector comprises a housing 1 of plastic material built up of a lower housing 2 and an upper housing 3 mounted thereon, a window 4 and an alarm light 5*a*. The alarm light 5*a* will light up when an alarm is generated in the case of an undesirable object entering the space to be kept under surveillance. The function of an alarm light 5*b* which is also present will be explained in more detail hereinafter yet. Disposed behind the window 4 is a passive infrared sensor in the form of a pyroelectric sensor (not shown in FIG. 1) which is sensitive to infrared light in the far infrared wavelength range. In the case of burglar entering the space to be kept under surveillance, for example, infrared light (having a wavelength of 6-50 um) emitted by the burglar (as a result of the latter's body heat) will be detected by the pyroelectric sensor acting as a passive infrared sensor, whereupon an alarm signal will be generated. The pyroelectric sensor of the surveillance detector thus functions as a motion detector. This in order to prevent the surveillance detector being sabotaged in its inactive state, for example when the pyroelectric sensor is deactivated during the daytime, for example by spraying lacquer or paint on the window 4 or, for example, by covering the surveillance detector in its entirety with a hat, a coat or the like, the surveillance detector is fitted with a so-called "anti-masking" system or "anti-sabotage" system. Said system thus functions as a general protection of the surveillance detector against sabotage attempts, in particular attempts to approach, mask or sabotage the detector. According to the invention, the aforesaid "anti-masking" system in the first place comprises a light guide 6 formed in one piece of plastic material, in particular polycarbonate, PMMA (polymethyl methacrylate), PET (polyethylene naphthalate) or PVC (polyvinyl chloride). The construction and the function of the light guide 6 will be explained in more detail with reference to FIGS. 2 and 3.

Figure 2:
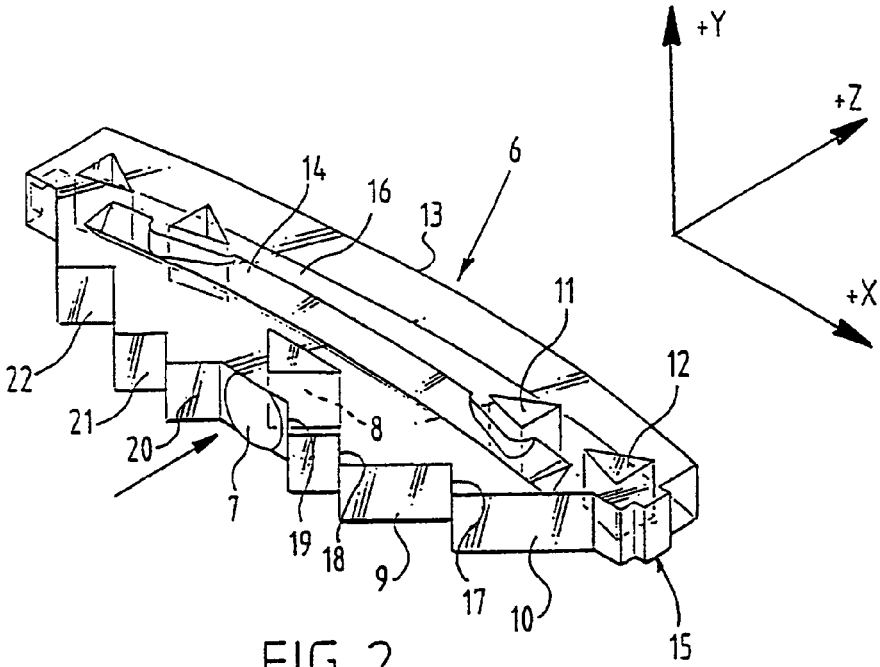
FIGS. 2 and 3 are schematic views of a first light guide used with the surveillance detector of FIG. 1.
Figure 3:
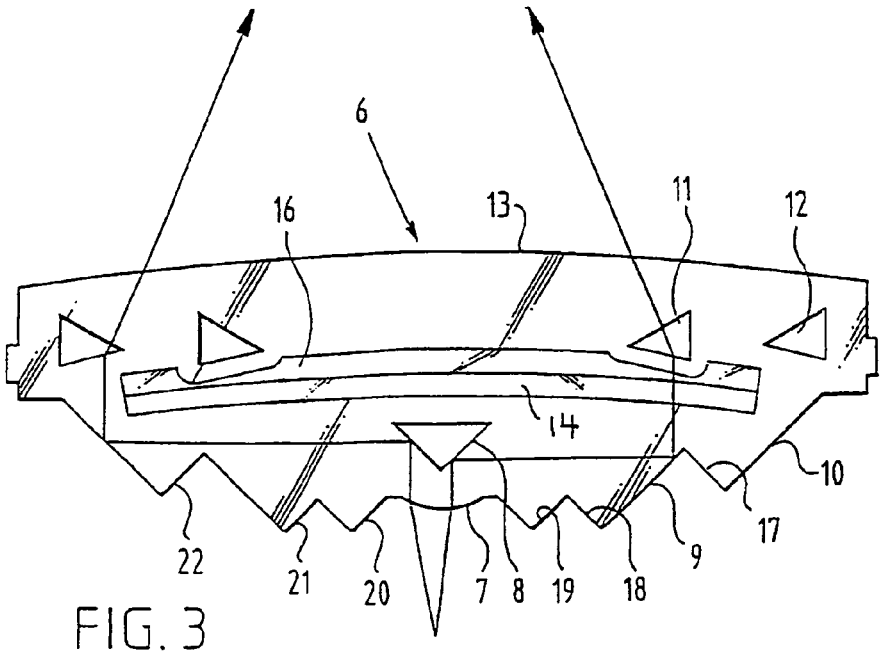

In FIG. 2, the light guide 6 is schematically shown in perspective view, whilst FIG. 3 schematically shows the light guide 6 in top plan view. Light rays emitted by a light emitter (not shown in FIGS. 2 and 3) disposed in the housing 1 fall onto the bottom side of the light guide 6 at the location of a collimator in the form of a collimating lens 7. Said collimating lens 7 causes the incident light rays thereon to be transmitted as a substantially parallel light beam to a beam splitter 8 in the form of two adjoining 45-degree light prisms. Internal reflections result in the light rays being deflected through an angle of about 90 degrees by the beam splitter, producing a left-hand (L) light beam and a right-hand (R) light beam. Since the light beam 6 is symmetric relative to a Y-Z plane shown in FIG. 2, only the further path of the right-hand (R) light beam will be described hereinafter, since the light path of the lefthand (L) light beam corresponds thereto, albeit in mirror image with respect to the aforesaid plane.

The reflectors 9,10 cause the light rays from the beam splitter 8 to be deflected through an angle of about 90 degrees in the direction of light prisms 11,12, which in turn deflect the light rays through an angle of about 30 degrees towards the aforesaid Y-Z-plane. Consequently, light propagating from the front side 13 of the light guide 6 will first converge and then diverge. The special advantage of this will be explained in more detail yet hereinafter. It is noted, however, that the slight curvature of the front side 13 of the light guide 6 hardly contributes to the deflection of the light, if at all. The aforesaid curvature has been provided for aesthetic reasons so as to have the front side 13 match the shape of the surface of the upper housing 3 (FIG. 1). About 75% of the incident light from the light emitter on the light guide 6 follows the light path as indicated above. About 25% of the light, however, will not reach the light prisms 11,12, since it has already reached a state of interaction with a reflector 14. Said reflector 14 has a surface exhibiting a curvature which concentrically follows the curvature of the front side of the light guide 6, whilst the surface at the same time extends at an angle of about 45 degrees to the vertical: the surface forms part of a cone, therefore. Light rays influenced by the reflector 14 propagate in downward direction towards the (negative) Y-axis (also shown in FIG. 2) and exit the light guide 6 from the bottom side 15 thereof (FIG. 5). Light rays which are scattered back to the light guide 6 by an undesirable object entering the space to be kept under surveillance and/or light rays being scattered back in the direction of the (negative) Z-axis on the front side 13 of the light guide 6 will subsequently fall onto a reflector 16. The reflector 16 has a surface which is curved in two directions, with two radii of curvature, so that the reflector has a toroid surface: one curvature follows the curvature of the front side 13 of the light guide 6 concentrically, whilst the other curvature lies in the Z-Y-plane, scattering the light back in the direction of the (negative) Y-axis. Retro-reflectors 17,18, 19,20,21,22 function to invert the light rays being scattered back in the direction of the (negative) Z-axis by the reflector 16 as regards their direction, and consequently direct them towards the (positive) Z-axis, so that said light rays will have a renewed possibility of reaching the reflector 14 and thus exit the light guide 6 from the bottom side 15 thereof. In this specific case, the light guide 6 is so designed that about 25% of the light that has been scattered back on account of the aforesaid causes will thus exit the light guide 6 at the location of the bottom side 15.

In summary, light rays propagating from the bottom side 15 of the light guide 6 in the direction of the (negative) Y-axis originate from light rays moving in the direction of the positive Z-axis (coming from the light emitter, therefore) and from light rays moving in the direction of the negative Z-axis (being reflected by the front side 13 and/or by an undesirable object entering the space to be kept under surveillance, therefore), in which connection the construction of the light guide 6 as such as well as sabotage attempts, whether willful or not, occurring in the vicinity of the front side of the light guide 6 play a role.

Figure 4:
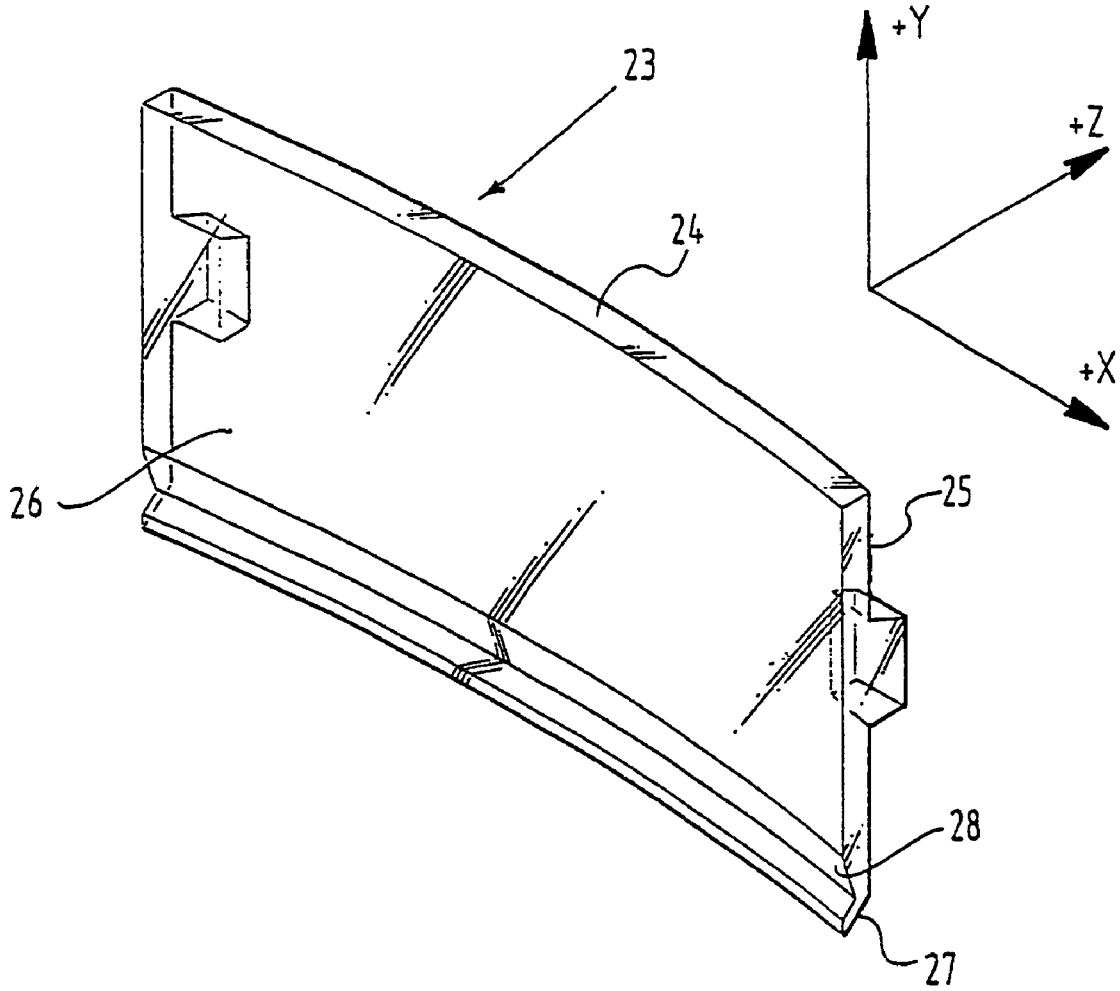
FIG. 4 is a schematic view of a second light guide used with the surveillance detector of FIG. 1.

Referring to FIGS. 1 and 5, the light rays propagating from the bottom side 15 of the light guide 6 subsequently fall onto a rear side 24 of a second light guide 23, bouncing against the surfaces 25, 26 of said second light guide 23 as they move towards the pointed end 27 of said second light guide 23. In this specific embodiment, the light guide 23 is so designed that about 50% of the light will arrive directly at said pointed end 27 and will thus be directed to the window 14. The remaining light will bounce against a reflector 28 disposed within the second light guide 23, as a result of which it will be deflected, and consequently it will follow a path away from the window 4. In its optical compartment, the surveillance detector accommodates a light receiver 29 for the above-explained "anti-sabotage" system, a pyroelectric sensor 30, a focusing mirror 31 and the window 4, which components jointly form the optical system of the passive infrared sensor. The light receiver 29 receives light rays which, coming from the second light guide 23, scatter through the window 4. In this specific case the construction has been designed such that about 10% of the light passed on by the second light guide 23 will indeed reach the light receiver 29 disposed behind the window 4. This percentage may be increased by forming the window 4 with a structure, which can be done by adding pigments or minerals and the like to the material of the window 4, by giving the window 4 a texture and/or by forming a relief on the window 4. In the present case, the window 4 has an outwardly extending projection 32 on its front side, which projection functions to intercept light rays coming from the pointed end 27 of the second light guide in an efficient manner and increase the percentage of incident light on the light receiver 29 through scattering. It is preferred to dispose the projection 32 as closely to the optical axis 33 of the light receiver 29 as possible, as is shown in the figure, i.e. at the location where the sensitivity of the light receiver 29 is greatest. The light emitter that has been referred to above is indicated by numeral 34 in FIG. 5 FIG. 4 shows a perspective view of the second light guide 23.

Summarising, since the first light guide 6 keeps an area in the vicinity of the present surveillance detector "under surveillance" whilst also keeping the window 4 "under surveillance" simultaneously therewith via optical coupling thereof to the second light guide 23, any attempt at approaching the surveillance detector and/or its window 4 by an object will lead to a significant increase or decrease (viz. scattering/reflection or absorption of emitted light by the object) of the light detected by the light receiver 29, as a result of which an alarm will be generated.

The aforesaid situation in which the light propagating from the front side 13 of the light guide 6 will first converge and then diverge, implies that the intensity of the light coming from the front side 13 of the light guide 6 will first increase and then gradually decrease. This renders the surveillance detector less sensitive in the sense that the presence of moving insects on the front side 13 of the light guide 6 will not result in an alarm being activated, since the light is distributed over (almost) the entire front side 13. In the area of maximum convergence of the light, i.e. at a distance of about 20-30 cm from the front side 13, the surveillance detector is sufficiently sensitive to detect drops, small things, dark objects etc. At a larger distance from the front side 13 of the light guide 6, for example at a distance of 50 cm or more, at which the light diverges with respect to the Z-axis, an undesirable object entering the space to be kept under surveillance can in principle be detected in two ways:

- incident light on the object can be scattered to the front side 13 of the light guide 6 (the possibility of detection taking place in this way decreases as the aforesaid distance increases);
- incident light on the object can be scattered to the window 4 (the possibility of this happening is relatively great because of the relative size of the window 4).

In both cases the amount of light received by the light receiver 29 has increased significantly.

EXAMPLE

A sheet of white paper of 15×15 cm is used for sabotaging the present surveillance detector. When said sheet of paper approaches the surveillance detector, detection will take place first the moment light rays coming from the front side 13 of the light guide 6 illuminate the left-hand side and the right-hand side of the sheet of paper. In one embodiment of the surveillance detector, detection takes place at a distance of 30-40 cm from the front side 13 in this case. At that distance a diverging light beam can be observed.

In a corresponding case, in which of a sheet of black paper of the same dimensions is used, detection takes place when more than 50% of the light rays coming from the front side of the light guide 6 fall onto the sheet of paper. This is the case at a distance of 20-30 cm from the front side 13. Although black paper exhibits a light reflection of only 2-5% of that of white paper, detection will still take place in an adequate manner, since the special shape of the light beam leads to a very strong increase of scattered light, and consequently of light received by the light receiver, as an object (white or black) comes nearer the front side 13 of the light guide 6.

Since the light beam propagating from the front side 13 on the light guide 6 first converges and then diverges, with the beam splitter 8 blocking light in the direction of the (positive) Z-axis, so that there is a light void (i.e. absence of light rays) in the centre of the converging light beam, the detector exhibits homogeneous sensitivity in the sense that both "white" objects and "black" objects are detected within a relatively small distance margin with respect to the front side 13 of the light guide 6. In such a case an alarm light 5*b* will light up and an alarm will be generated.

FIG. 6 is a highly schematic view of the principle of operation of the first light guide 6. The light guide 6 is optically coupled both to the light emitter 34 and to the light receiver 29, and thus functions as a guide both of emitted light and of received light, depending on the direction in which the light propagates.

The invention is not limited to the embodiments as described above, it also extends to other variants that fall within the scope of the appended claims.

The invention claimed is:

1. A surveillance detector comprising a light emitter and a first light guide which is optically connected to the light emitter, the first light guide includes reflectors mounted therein, wherein the first light guide is configured to convert the light from the light emitter at least in part into a light beam to be built up in a space to be kept under surveillance, and wherein the light guide is configured to guide light from the light beam that is reflected by an object in the space to be kept under surveillance, through a second light guide, to a light receiver of the detector, which is optically coupled to the first light guide, and wherein the light guides guide part of the light from the light emitter to the light receiver before the light beam exits the detector.

2. A surveillance detector according to claim 1, wherein the light beam propagates convergingly from a light guide surface that faces towards the space to be kept under surveillance.

3. A surveillance detector according to claim 2, wherein the light beam propagates divergingly from a distance of 5-100 cm from the light guide surface that faces towards the space to be kept under surveillance.

4. A surveillance detector according to claim 2, wherein the light beam propagates divergingly from a distance of 20-30 cm from the light guide surface that faces towards the space to be kept under surveillance.

5. A surveillance detector according to claim 1, wherein the first light guide is capable of guiding 1-50% of the light from the light emitter to light receiver before said light exits the detector.

6. A surveillance detector according to claim 1, wherein the light from the light emitter that is guided to the light receiver by the first light guide before it exits the detector comprises, at least in part, light which is reflected from the light guide surface that faces towards the space to be kept under surveillance.

7. A surveillance detector according to claim 1, wherein the first light guide comprises retroreflectors for reflecting light which is being scattered back into the light guide to the light receiver.

8. A surveillance detector according to claim 1, wherein the second light guide includes reflectors mounted therein.

9. A surveillance detector according to claim 8, wherein the second light guide guides the light to the light receiver via a light-transmitting window of the detector, behind which said light receiver is disposed.

10. A surveillance detector according to claim 9, wherein the window comprises an outwardly extending projection.

11. A surveillance detector according to claim 8, wherein the second light guide tapers off into a pointed shape, adjoining surfaces of which form internal reflection surfaces which are inclined at a certain angle so as to cause the light to exit along a desired path.

12. A surveillance detector according to claim 1, further comprising alarm means for generating an alarm in the case that the light received by the light receiver corresponds to a signal value which is higher than a maximum level or lower than a minimum level.

13. A surveillance detector according to claim 1, further comprising a passive sensor for detecting an object entering the space to be kept under surveillance.

14. A surveillance detector according to claim 13, wherein said passive sensor is a passive infrared sensor.

15. A surveillance detector according to claim 1, further comprising an active sensor for detecting an object entering the space to be kept under surveillance, in which said active sensor comprises a wave signal source and a wave signal detector coupled thereto.

16. A surveillance detector according to claim 15, wherein said wave signal source and said wave signal detector operate on the basis of ultrasonic waves or microwaves.

17. A surveillance detector according to claim 1, wherein the first light guide is capable of guiding 5-30%, of the light from the light emitter to light receiver before said light exits the detector.

* * * * *